US007600850B2

(12) United States Patent
Blackburn et al.

(10) Patent No.: US 7,600,850 B2
(45) Date of Patent: Oct. 13, 2009

(54) INTERNAL VENT CHANNEL IN EJECTION HEAD ASSEMBLIES AND METHODS RELATING THERETO

(75) Inventors: Jonathan Michael Blackburn, Mt. Sterling, KY (US); Edgar Colin Diaz, Chihauhua (MX); Thomas Ray Romine, Jr., Franklort, KY (US); Jeanne Marie Saldanha Singh, Lexington, KY (US); Mary Claire Smoot, Lexington, KY (US); Jason Joseph Stokesbary, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 407 days.

(21) Appl. No.: 11/365,193

(22) Filed: Mar. 1, 2006

(65) Prior Publication Data

US 2007/0206067 A1 Sep. 6, 2007

(51) Int. Cl.
*B41J 2/015* (2006.01)

(52) U.S. Cl. ..... 347/20

(58) Field of Classification Search ..... 347/20, 347/40, 45, 47, 87; 216/27, 33
See application file for complete search history.

(56) References Cited

U.S. PATENT DOCUMENTS 5,434,607 A * 7/1995 Keefe ..... 347/50
5,710,584 A 1/1998 Suzuki et al.
5,736,998 A * 4/1998 Caren et al. ..... 347/45
5,751,324 A 5/1998 Brandon et al.
5,826,333 A 10/1998 Iketani et al.
5,874,971 A * 2/1999 Nishioka et al. ..... 347/20
5,898,449 A 4/1999 Narang et al.
6,033,581 A * 3/2000 Kobayashi ..... 216/27
6,175,261 B1 1/2001 Sundararaman et al.
6,193,362 B1 2/2001 Nakata et al.
6,325,491 B1 12/2001 Feinn
6,361,160 B2 3/2002 Feinn et al.
6,364,475 B2 4/2002 Feinn et al.
6,488,366 B1 * 12/2002 Potochnik et al. ..... 347/65
6,554,399 B2 4/2003 Wong et al.
6,747,346 B2 6/2004 Saito et al.
6,766,817 B2 7/2004 da Silva
6,890,065 B1 5/2005 Spivey et al.
6,902,260 B2 6/2005 Aschoff et al.
6,935,727 B2 8/2005 DaQuino et al.

(Continued)

FOREIGN PATENT DOCUMENTS

JP 2004-050818 2/2004

*Primary Examiner*—Anh T. N. Vo
(74) *Attorney, Agent, or Firm*—Luedeka, Neely & Graham

(57) ABSTRACT

Fluid ejection head assemblies, fluid ejection devices, and methods for improving fluid sealing of fluid ejection head assemblies. One such fluid ejection head assembly includes a substrate cavity and a substantially planar surface surrounding the substrate cavity. The substantially planar surface contains at least one external vent, at least one internal vent channel, and a plurality of vents in fluid flow communication with the substrate cavity and providing fluid flow communication between the internal vent channel and the external vent. The plurality of vents, the at least one external vent and the at least one internal vent channel are disposed in fluid flow communication with an environment external to the substrate cavity for flow of a gas associated with an adhesive at least partially disposed in the substrate cavity, to the environment during the curing of the adhesive.

20 Claims, 6 Drawing Sheets

U.S. PATENT DOCUMENTS

| | | | | |
|---|---|---|---|---|
| 7,285,255 | B2 | 10/2007 | Kadlec et al. | |
| 7,354,138 | B2 * | 4/2008 | Yokouchi | 347/56 |
| 2003/0007042 | A1 | 1/2003 | Lu et al. | |
| 2003/0142172 | A1 | 7/2003 | Schmidt et al. | |
| 2004/0098397 | A1 | 5/2004 | Suzuki et al. | |
| 2005/0036010 | A1 | 2/2005 | Terakura et al. | |
| 2005/0036012 | A1 | 2/2005 | Terakura | |

* cited by examiner

INTERNAL VENT CHANNEL IN EJECTION HEAD ASSEMBLIES AND METHODS RELATING THERETO

FIELD

The disclosure relates to micro-fluid ejection heads, and in particular to improved micro-fluid ejection head assemblies and methods for assembling micro-fluid ejection devices.

BACKGROUND AND SUMMARY

Micro-fluid ejection heads are useful for ejecting a variety of fluids including inks, cooling fluids, pharmaceuticals, lubricants and the like. A widely used micro-fluid ejection head is in an ink jet printer. Ink jet printers continue to be improved as the technology for making the micro-fluid ejection heads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers and supplies for such printers in a more costs efficient manner than their competitors.

An illustrative micro-fluid ejection device is illustrated in FIG. 1. The micro-fluid ejection device includes an integral fluid reservoir 10 for holding fluid to be ejected from a micro-fluid ejection head 12 that is attached to a head portion 14 of the fluid reservoir 10. The geometry of a prior art head portion 14 of the fluid reservoir 10, as shown in FIGS. 2 and 3 (prior art), may include features such as a substrate cavity 16 with a length and width designed to provide sufficient space to fixedly attach and seal a substrate 18 in the cavity 16 with a die bond adhesive, and may seal a TAB circuit 34 to the fluid reservoir 10 with a die bond adhesive in vent channels 27A and 27B on a deck 36. The substrate cavity 16 has at least one fluid supply slot (each referred to hereinafter as a via 20) disposed therein, and may have two or more vias 20 in a floor portion 22 of the cavity 16 for permitting fluid to flow from the reservoir 10 to the substrate 18 when the micro-fluid ejection head 12 is used. The vias 20 typically contain narrow walls (sometimes referred to herein as "racetracks" 24) adjacent at least one side 26 thereof for spacing the substrate 18 from the floor portion 22 of the cavity 16. The narrow walls 24 provide room for the die bond adhesive to secure the substrate 18 in the substrate cavity 16 and to provide sufficient adhesive seal against the substrate 18 to prevent fluid leakage out of the cavity 16 and/or vias 20.

In order to provide adequate flow of adhesive throughout the substrate cavity 16, and to properly seal the TAB circuit 34 to the fluid reservoir 10, vents 27A and 27B leading to external vent channels 28 and 30 are located on opposing sides of the substrate cavity 16. The vents 27A and 27B can direct the adhesive and associated gasses (e.g., outgasses and volatiles) from the substrate cavity 16 so that it may seal against the back side 32 of a TAB circuit 34, which is used to operatively connect the substrate 18 to a micro-fluid ejection control device such as a printer. The vents 27A and 27B also provide adhesive flow to external vent channels 28 and 30 that help to minimize gas bubbles in the adhesive as the adhesive wicks into the vents 27A and 27B and vent channels 28 and 30 and cures. The adhesive is also effective to seal the external vent channels 28 and 30 so that fluid from the substrate cavity 16 may not escape through the vents 27A and 27B and vent channels 28 and 30 after the adhesive has cured. Typically, vents 27A and 27B have a periodic spacing 29 along a length of the substrate cavity of about 2 millimeters.

Conventionally, the volume of adhesive in the substrate cavity 16 and in the vents 27A and 27B and vent channels 28 and 30 is critical to providing suitable corrosion protection for a back side 32 of the TAB circuit 34 that is attached to a substantially planar surface 36 of the head portion 14 of the fluid reservoir 10. Too much adhesive in the vent channels 28 and 30 may affect TAB circuit 34 topography, as described in more detail below, thereby reducing the performance of the micro-fluid ejection head. Inadequate sealing of the back side 32 of the TAB circuit 34 due to adhesive location, or the presence of gas bubbles in the adhesive, should be minimized. While the vents 27A and 27B and vent channels 28 and 30 have provided some improvement in the ability to seal the back side 32 of the TAB circuit 34, gas bubbles and adhesive topography, for example, continue to be a problem. Accordingly, there continues to be a need for methods and apparatus that, among other things, increase adhesion area and/or increase gas venting capabilities during assembly of micro-fluid ejection devices. In view of the foregoing and/or other reasons, exemplary embodiments of the disclosure provide fluid ejection head assemblies, fluid ejection devices, and methods for improving fluid sealing of fluid ejection head assemblies. One such fluid ejection head assembly includes a substrate cavity and a substantially planar surface surrounding the substrate cavity. The substantially planar surface contains at least one external vent, at least one internal vent channel, and a plurality of vents in fluid flow communication with the substrate cavity and providing fluid flow communication between the internal vent channel and the external vent. The plurality of vents, the at least one external vent and the at least one internal vent channel are disposed in fluid flow communication with an environment external to the substrate cavity for flow of a gas associated with an adhesive at least partially disposed in at least one of the substrate cavity and the at least one internal vent channel, to the environment during the curing of the adhesive.

In another embodiment there is provided a method for improving sealing between a circuit, such as a TAB circuit, and a fluid ejection assembly. The fluid ejection assembly has a substantially planar surface, a substrate cavity, and a vent system placing the substrate cavity in fluid flow communication with an environment external to the substrate cavity. The vent system includes an internal vent channel, an external vent, and a plurality of connecting vent channels connecting the internal vent channel and the external vent to one another. An amount of adhesive is disposed in the substrate cavity and in the internal vent channel sufficient to substantially attach and to substantially seal a substrate in the substrate cavity, and to substantially seal a backside of a circuit (e.g., to the fluid ejection assembly), thereby enhancing corrosion protection of lead beams on the circuit.

Still another embodiment provides a method for improving sealing between a circuit and a fluid ejection assembly. The fluid ejection assembly has a substantially planar surface substantially surrounding a recessed substrate cavity, and a vent system in the substantially planar surface. The vent system is in fluid flow communication with the substrate cavity. The vent system includes at least one external vent, at least one internal vent channel disposed between the external vent and the substrate cavity, and a plurality of connecting vent channels orthogonal to the internal vent channels. The connecting vent channels are in fluid flow communication with the substrate cavity, the internal vent channel and the external vent. An adhesive is disposed in at least one of the substrate cavity and the internal vent channel to substantially fill the substrate cavity and flow into the vent system. A micro-fluid ejection head is attached to the adhesive in the substrate cavity. A circuit is attached to the micro-fluid ejection head and at least a portion of the substantially planar surface. The adhesive is cured.

Yet another embodiment provides a micro-fluid ejection head device including a recessed substrate cavity. A substantially planar surface substantially surrounds the substrate cavity. A vent system is disposed in the substantially planar surface in fluid flow communication with the substrate cavity and an environment external to the substrate cavity. The vent system includes an internal vent channel, an external vent, and a plurality of connecting channels orthogonal to the internal vent channel. The connecting vent channels are in fluid flow communication with the substrate cavity, the internal vent channel and the external vent.

BRIEF DESCRIPTION OF THE DRAWINGS

Further features and advantages of the disclosed embodiments may become apparent by reference to the detailed description when considered in conjunction with the figures, which are not to scale, wherein like reference numbers indicate like elements through the several views, and wherein.

DETAILED DESCRIPTION OF THE EXEMPLARY EMBODIMENTS

Figure 4A:
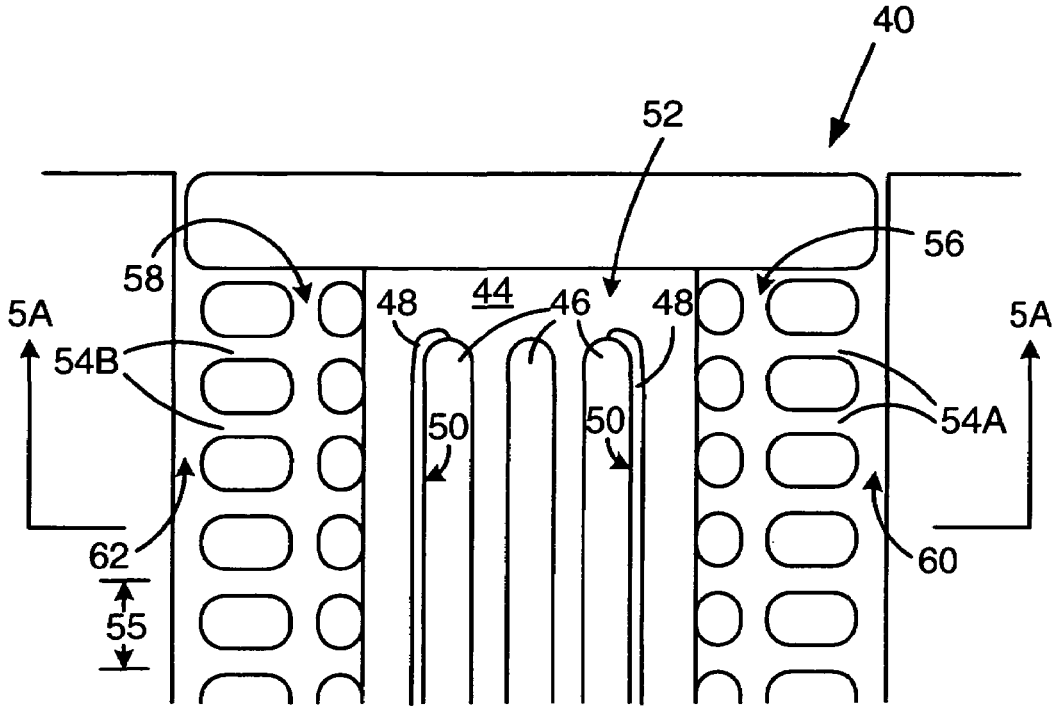
FIGS. 4A and 4B are plan views, not to scale, of a portion of a micro-fluid ejection head assembly according to an embodiment of the disclosure.
Figure 5A:
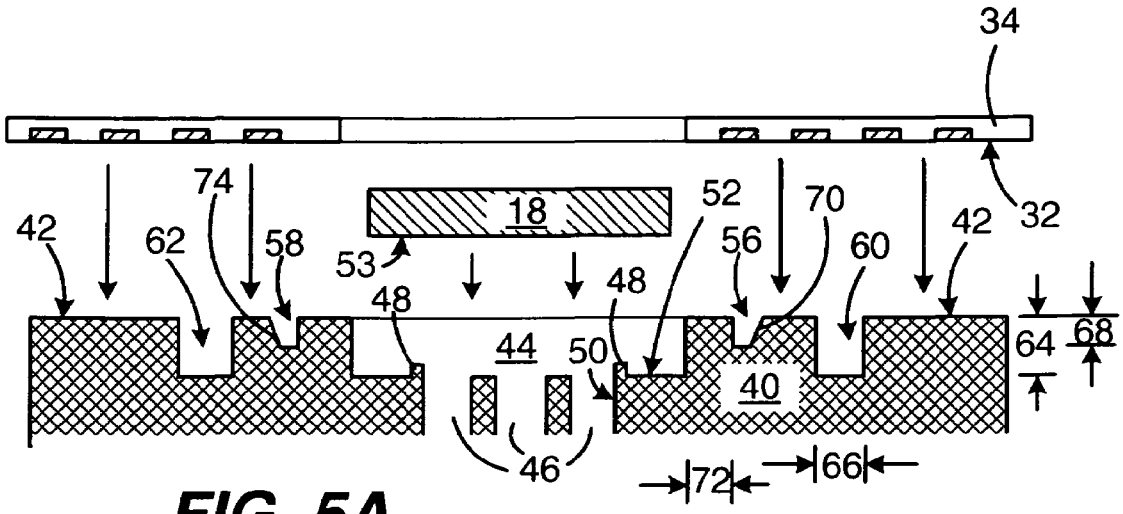
FIG. 5A is a cross-sectional view, not to scale, of a portion of a micro-fluid ejection head assembly according to the disclosure taken along lines 5A-5A of FIG. 4A.

With reference to FIGS. 4A and 5A, a portion 40 of a micro-fluid ejection head assembly 40, according to an exemplary embodiment of the disclosure, for a micro-fluid ejection head 12 is illustrated in plan view and cross-sectional view. The head assembly 40 has a substantially planar surface (referred to hereinafter as a "deck") 42, which substantially surrounds a recessed area referred to herein as a substrate cavity 44. The substrate cavity 44 contains one or more vias 46 therein through which a fluid such as ink may flow for ejection by fluid ejection actuators on the substrate 18. Racetracks 48 may be located adjacent an outer edge 50 of outer vias 46. The racetracks 48 provide space between a floor area 52 of the substrate cavity 44 and the substrate 18 when the substrate 18 is adhesively attached in the substrate cavity 44. For example, a racetrack 48 and/or risers can maintain a vertical distance between the floor area 52 of the cavity 44 and a bottom surface 53 of the substrate 18, to ensure adequate sealing volume of adhesive there between. Although shown in the illustrated embodiments as a continuous, integral wall, a racetrack may comprise one or more protrubences (sometimes referred to herein as risers) on the floor 52 of cavity 44.

Figure 1:
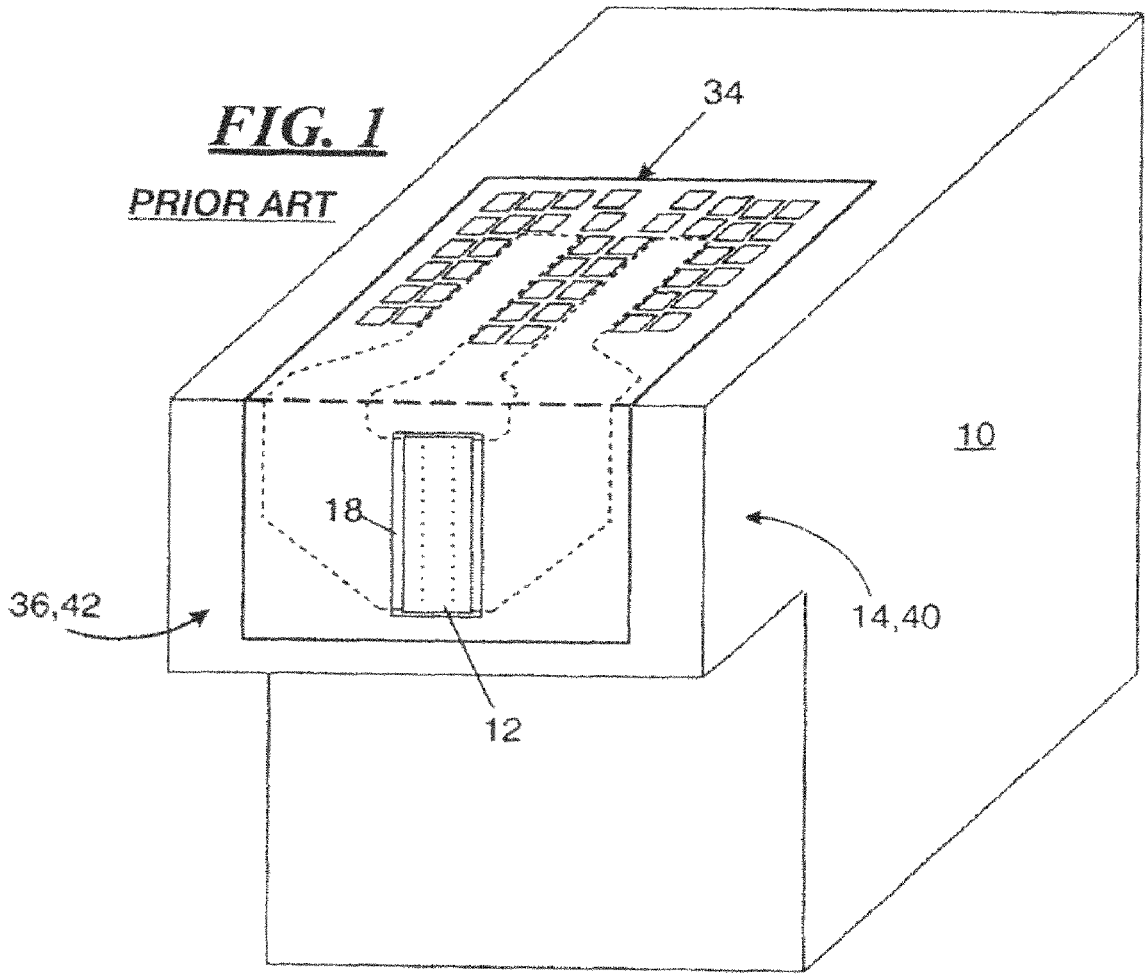
FIG. 1 PRIOR ART
FIG. 1 is a perspective view, not to scale, of a micro-fluid ejection head device containing a fluid reservoir and micro-fluid ejection head assembly.
Figure 2:
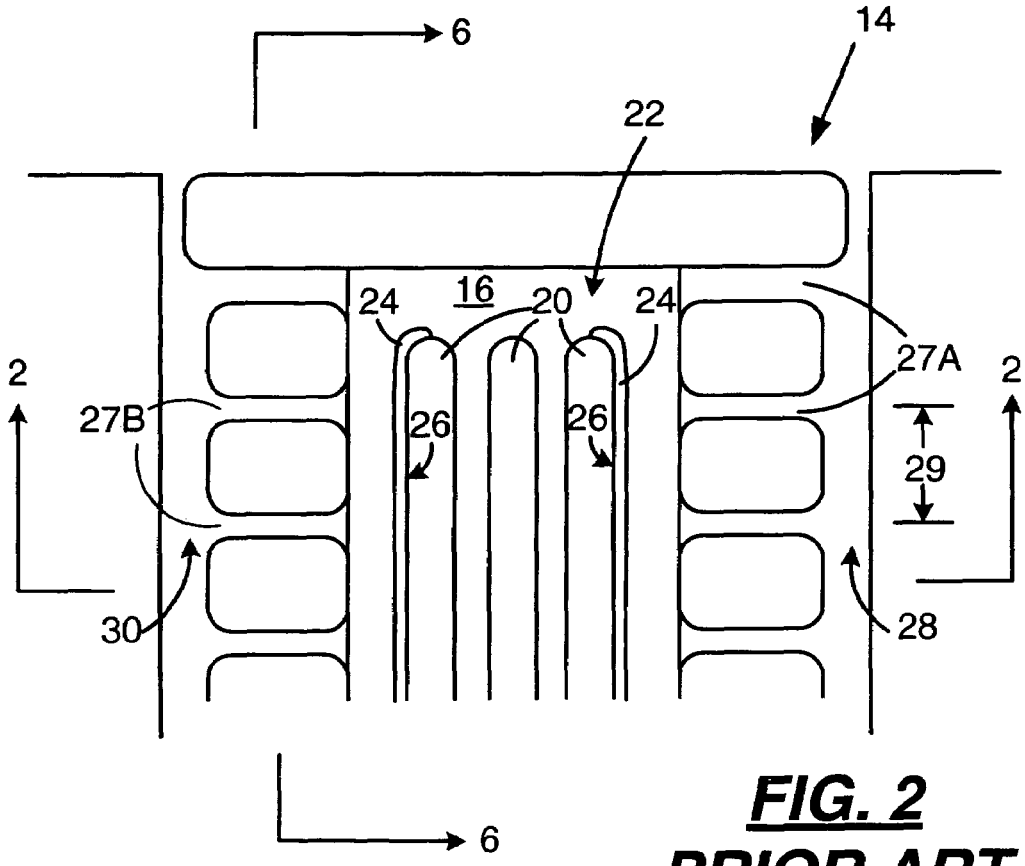
FIG. 2 PRIOR ART
FIG. 2 is a plan view, not to scale, of a portion of a prior art micro-fluid ejection head assembly.

In order to, for example, improve the flow of adhesive from the substrate cavity 44 as described above, a vent system including vents 54A and 54B are provided. Unlike the prior art vents 27A and 27B (FIGS. 2 and 3), vents 54A and 54B in an exemplary embodiment of the invention, have a periodic spacing 55 less than the periodic spacing 29 (FIG. 2). Typically, the periodic spacing 55 of vents 54A and 54B might range from about 0.5 to about 1.5 millimeters. The vents 54A and 54B provide for flow of adhesive to one or more internal vent channels 56 and 58 that, in one embodiment, are substantially parallel to a length of the substrate cavity 44 and to external vent channels 60 and 62.

Referring now to FIG. 5A, a cross sectional view 5A-5A of a portion of the head assembly 40 according to an exemplary embodiment of the disclosure is illustrated. Starting at the right-hand side of FIG. 5A and moving to the left-hand side of FIG. 5A, the deck 42 is shown. The deck 42 provides a surface to which a circuit, such as a flexible circuit (in an exemplary embodiment, a TAB circuit 34) may be attached, such as by a pressure sensitive adhesive and/or a die bond adhesive. Moving further from right to left in FIG. 5A, external vent channel 60 is shown. The external vent channel 60 has a depth 64, which in one embodiment ranges from about 0.2 to about 0.3 millimeters. In an exemplary embodiment, the depth 64 of external vent channel 60 is equal to or greater than that of an internal vent channel, such as channel 56. Meanwhile, a width 66 of the external vent channel 60 ranges from about 0.2 millimeters to about 1.0 millimeters.

Continuing to move from right to left toward the substrate cavity 44, the vent system also provides internal vent channel 56. In one embodiment, internal vent channel 56 has a depth 68 ranging from about 0.08 to about 0.15 millimeters. Depending on, for example, the rheology characteristics of the die bond adhesive 84, the internal vent channel 56 may include at least one slanted side wall 70 for assisting in proper filling of the internal vent channel 56 with the die bond adhesive 84 as the adhesive wicks away from the substrate cavity 44 toward the deck 42. With further reference to FIG. 5A, a distance 72 between the internal vent channel 56 and the substrate cavity 44 may range from about 0 millimeters to about 1.5 millimeters.

Next, moving toward the left in FIG. 5A there is provided a substrate cavity 44 having a floor 52 that is recessed from the deck 42 a distance that, in one embodiment, is equal to or greater than the depth 64 of the external vent channel 60. Vias 46 are provided in the floor 52 of the substrate cavity 44 to permit liquid to pass from, for example, a fluid reservoir in a fluid reservoir body 10 toward the substrate 18 attached, as by the die bond adhesive 84, to the substrate cavity 44. As set forth above, the vias 46 may be partially surrounded by racetracks 48 and/or risers (not shown) that space the substrate 18 from the floor 52 in the substrate cavity 44.

Continuing to move from right to left, the vent system provides internal vent channel 58, which has a depth 68 and, in the illustrated embodiment, a slanted side wall 74, similar to the slanted side wall 70 of internal vent channel 56. Moving further to the left, there is shown an external vent channel 62 and the deck 42. In an exemplary embodiment, the external vent channel 62 can have substantially the same depth 64 and width 66 as the external vent channel 60.

Figure 3:
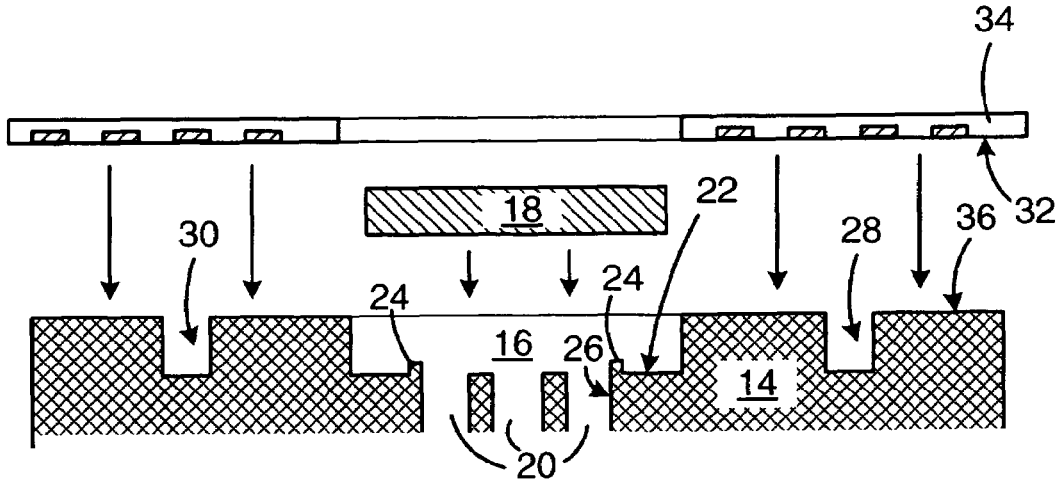
FIG. 3 PRIOR ART
FIG. 3 is a cross-sectional view, not to scale, of a portion of a prior art micro-fluid ejection head assembly taken along lines 2-2 of FIG. 2.
Figure 4B:
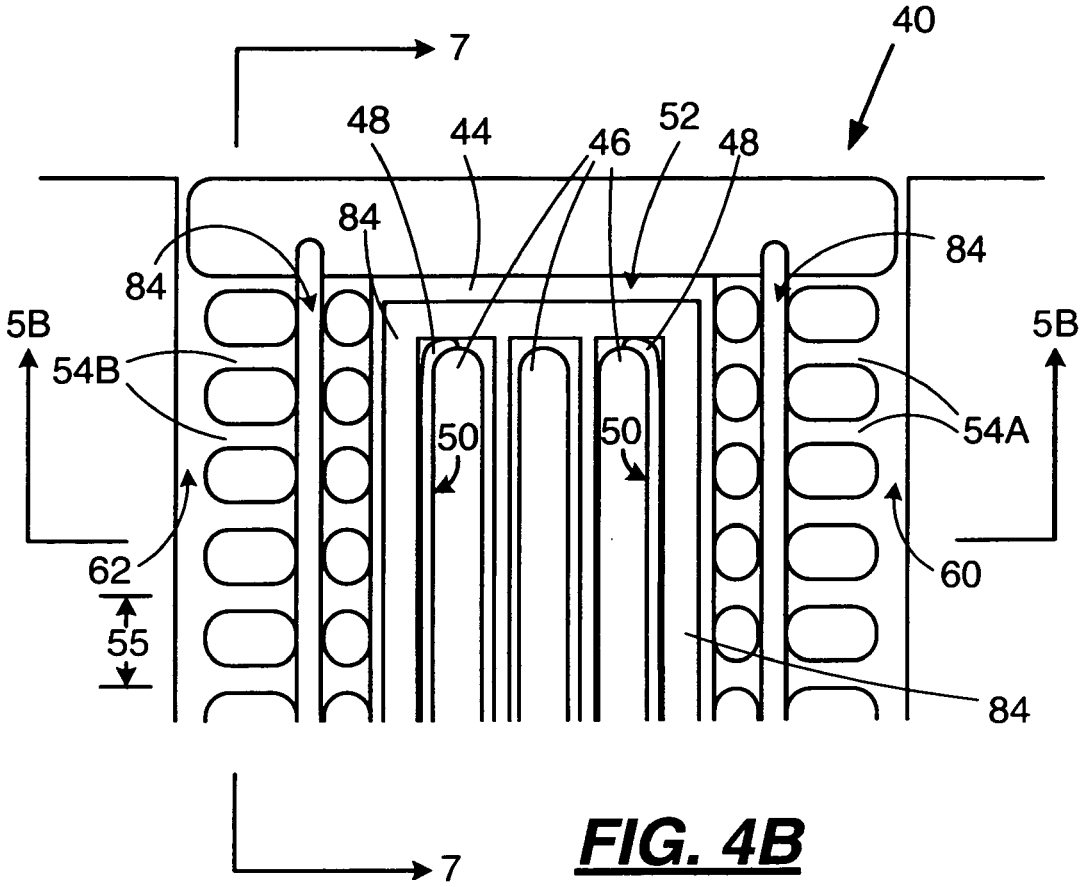
Figure 5B:
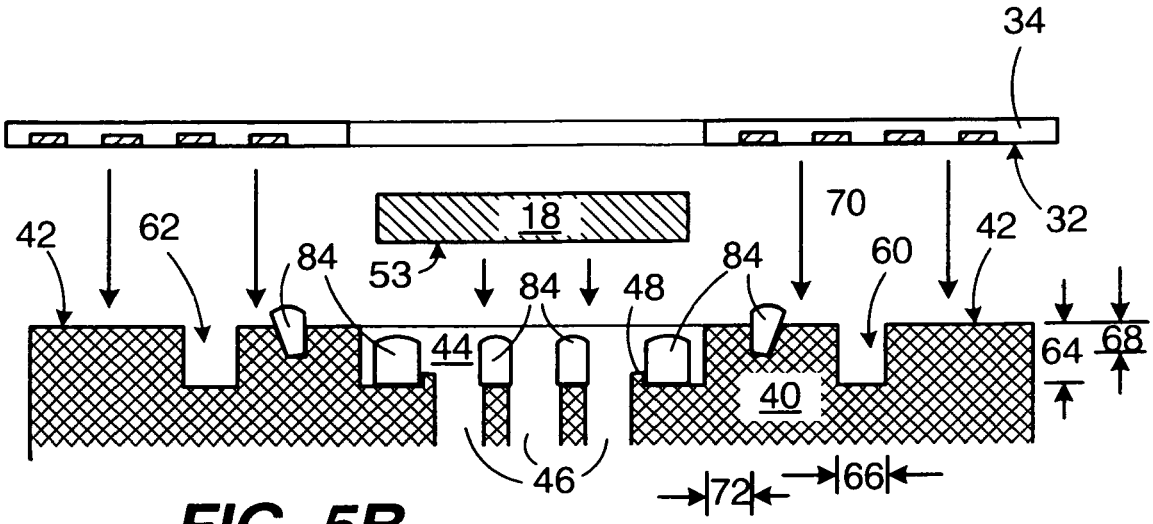
FIG. 5B is a cross-sectional view, not to scale, of a portion of a micro-fluid ejection head assembly according to the disclosure taken along lines 5B-5B of FIG. 4B.

Referring to FIGS. 4B and 5B, as the die bond adhesive 84 is dispensed in the substrate cavity 44 for attaching substrate 18, the adhesive 84 substantially covers the floor 52 of the substrate cavity 44 between the vias 46. The adhesive 84 also fills the space between the floor 52 and the substrate 18 provided by racetracks 48. Adhesive 84 may also be placed on deck 42, such as in vents 56 and 58, for attaching a circuit, (e.g., TAB circuit 34), where it can then wick into vents 54A and 54B so that it fills the vents 54A and 54B. As TAB circuit 34 is attached, for example, adhesive 84 may be displaced such that it may flow down into cavity 44 and/or external vent channels 60 and 62. Despite the closer periodic spacing of vents 54A and 54B, the venting volume for the adhesive 84 may be substantially the same as the venting volume for vents 27A and 27B and vent channels 28 and 30 (FIGS. 2 and 3).

While not desiring to be bound by theoretical considerations, it is believed that the internal vent channels 56 and 58 provide reduced wicking flow of the adhesive 84 thereby reducing the formation of voids in the adhesive 84 as the adhesive 84 flows into that the vents 54A and 54B and vent channels 56-62. A more aggressive wicking of the adhesive provided by the vents 27A and 27B and vent channel 28-30 design of FIGS. 2 and 3 often results in the formation of voids in the die bond adhesive that may lead to the flow of fluid to the back side 32 of the TAB circuit 34 thereby increasing a rate of corrosion of unprotected tracing and connections on the back side of the TAB circuit 34. The voids in the vents 27A and 27B and vent channels 28 and 30 of the prior art head portion 14 are difficult to fill with encapsulating material after the substrate and a flexible circuit are attached to the head portion 14. Meanwhile, internal vent channels 56 and 58 retain adhesive 84 in the appropriate location(s) to properly seal the circuit to the deck 42 and provide corrosion protection thereto.

By providing more frequent venting, more gas has an opportunity to escape. The improved venting volume is equal to or greater than the prior art volume. Among other important benefits, reducing the trapped gas volume can improve corrosion protection and back-side sealing of a TAB circuit 34.

Figure 7:
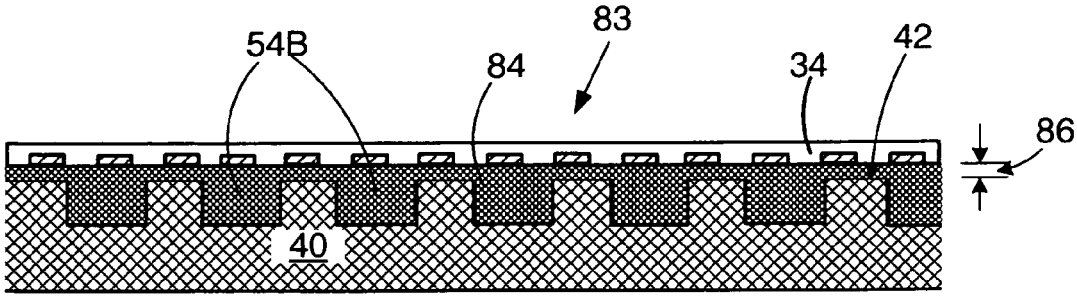
FIG. 7 is a cross-sectional view, not to scale, of a portion of a micro-fluid ejection head assembly according to the disclosure taken along lines 7-7 of FIG. 4.

In the prior art design, placement of the diebond adhesive on the deck 36 may cause mounding of the adhesive on the deck below the TAB circuit 34, leading to undesirable topographical variations in the TAB circuit 34. Accordingly, another advantage of the vent system design illustrated in FIGS. 4 and 5 is that the internal vent channels 56 and 58 provide additional locations for the die bond adhesive 84 so that mounding of the adhesive 84 on the deck 42 is minimized. Referring now to FIG. 7, in an exemplary embodiment, for example, the channels 56 and 58 may be used to allow die bond adhesive 84 to be placed on the head assembly 40 such that the die bond adhesive 84 achieves a height 86 (between the deck 42 and a TAB circuit 34) of between about 0.050 millimeters and about 0.1 millimeters.

Figure 6:
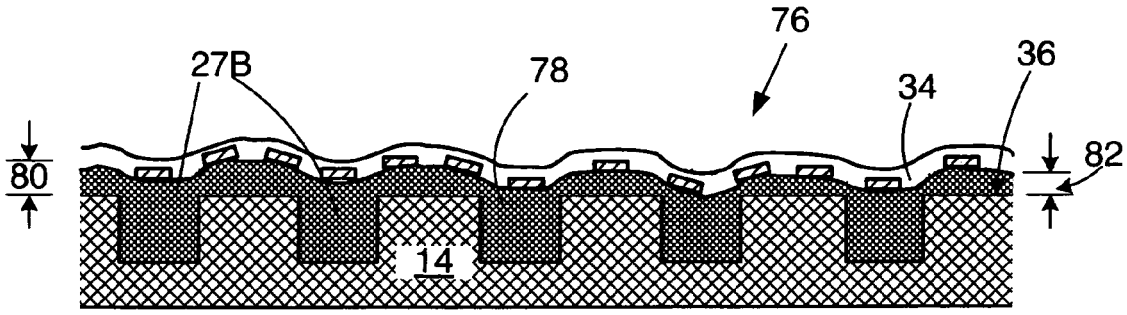
FIG. 6 PRIOR ART
FIG. 6 is a cross-sectional view, not to scale, of a portion of a prior art micro-fluid ejection head assembly and attached flexible circuit taken along lines 6-6 of FIG. 2.

Referring now to FIG. 6, cross section view 6-6 from FIG. 2 is shown. The cross sectional view provides a micro-fluid ejection head assembly 76, which may include a substrate (not shown) of a micro-fluid ejection head (not shown) attached to a head portion 14 of a fluid reservoir 10, including several vents 27B with a die bond adhesive 78 filling the vents 27B. The TAB circuit 34 is sealed by the die bond adhesive 78 to the deck 36. However, with the prior art design illustrated in FIG. 6, the adhesive 78 has an inconsistent thickness as shown. On the left-hand side of FIG. 6, the adhesive 78 has a thickness 80 of about 0.195 millimeters. However, on the right-hand side of FIG. 6, the adhesive has a thickness 82 of about 0.100 millimeters. The uneven adhesive thickness is partially due to the variation in height of the adhesive 78 placed on the deck 36 and in the vents 27B.

By comparison, as shown in FIG. 7, a micro-fluid ejection head assembly 83 containing the internal vent channels 56 and 58, and an external vent (e.g., channels 60 and 62 (FIGS. 4 and 5)), can provide a number of benefits compared to an assembly that only utilizes vent channels 28 and 30 (FIG. 3). For example, when the substrate 18 is attached, as by a die bond adhesive 84, to the head portion 40 (in the substrate cavity 44), and the backside 32 of the circuit 34 is attached to deck 42 with adhesive 84, the die bond adhesive tends to fill the internal vent channels 56 and 58 first, and then moves to fill an area between the backside 32 of the circuit 34, thereby sealing it against corrosion. The internal vent channels 56 and 58 provide a location for the adhesive 84 to flow to provide a seal against ingression of fluid to an area between the TAB circuit 34 and the deck 42. Accordingly, the internal vent channels 56 and 58 tend to equalize the level of the adhesive 84 between the TAB circuit 34 and the deck 42, as shown in FIG. 7, so that the adhesive 84 has substantially one thickness 86 (e.g., of about 0.1 mm) between the TAB circuit 34 and the deck 42. As a result, embodiments of the disclosure may provide enhanced overall planarity of a TAB circuit 34 when the TAB circuit 34 is attached to a head assembly 40 containing internal and external vent channels 56-62.

Referring back to FIGS. 4 and 5, the embodiments described herein also enable movement of the external vent channels 60 and 62 toward the substrate cavity 44 thereby providing an increased surface area of the deck 42 compared to the surface area of the deck 36 in the prior art design. The increased surface area of deck 42 may further improve the sealing capabilities of a pressure sensitive adhesive that might be used to attach the TAB circuit 34 to the deck 42. Another advantage of the increased deck 42 surface area is that more surface area provides better adhesion and improved circuit planarity to attach a TAB circuit 34 to the deck 42 and seal it against corrosion and ink ingression.

Figure 8:
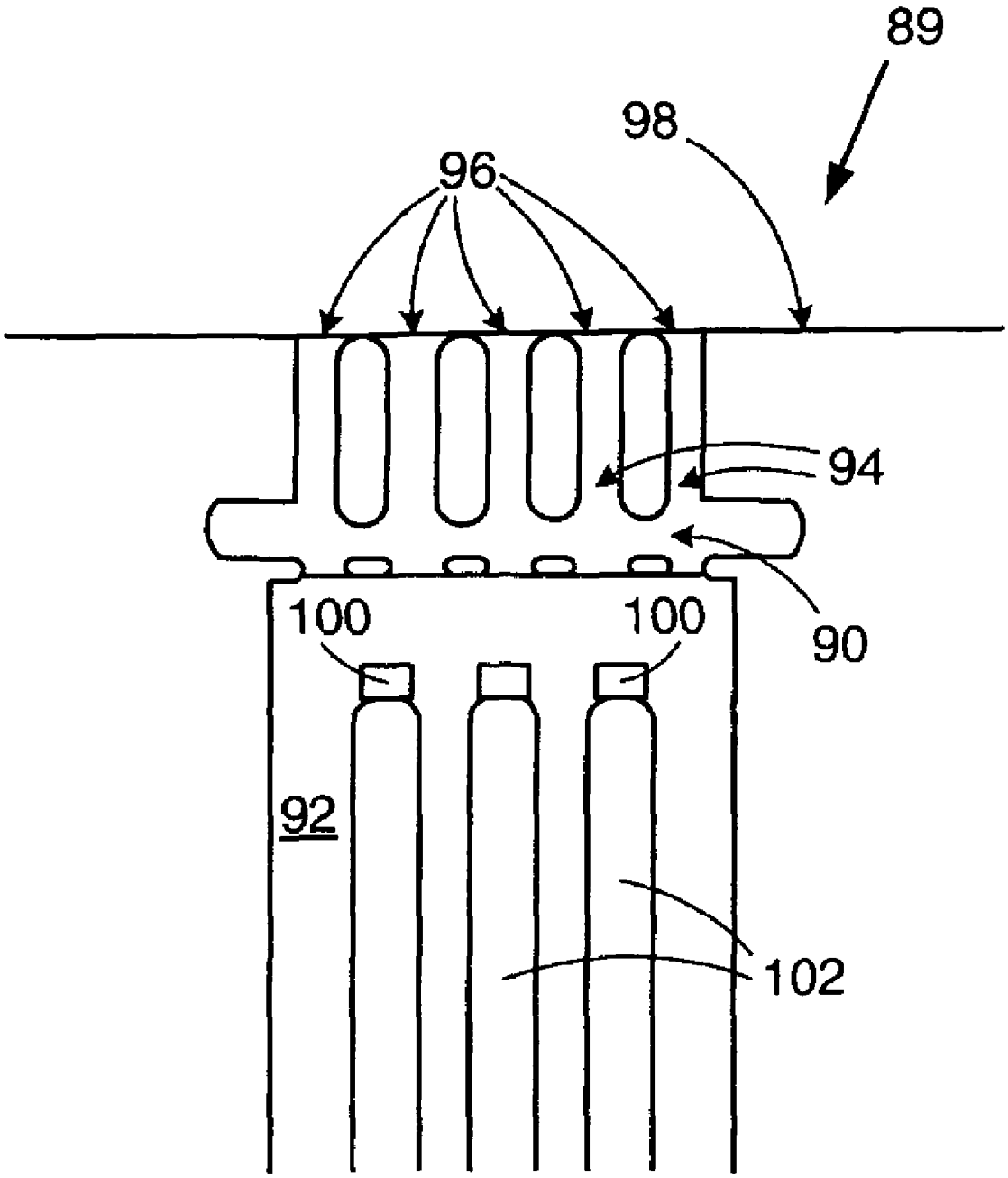
FIG. 8 is a plan view, not to scale of a portion of a micro-fluid ejection head assembly according to another embodiment of the disclosure.

In another exemplary embodiment, illustrated in FIG. 8, a micro-fluid ejection head assembly 89 may contain one or more vent channels 90 that are substantially perpendicular to a length of a substrate cavity 92. In one such embodiment, one or more of the external vent "channels" 60 and 62, as shown with respect to FIGS. 4A and 4B, may be obviated. For example, vents 94 may be formed that communicate to the environment by way of external vents 96 defined by, for example, an end of a respective vents 94 at an edge 98 of the micro-fluid ejection head assembly 89. Moreover, such an embodiment might utilize one or more risers 100 adjacent the ends of one or more of vias 102 to provide for a volume of adhesive between a substrate and the substrate cavity 92. Such an embodiment might help reduce a width of the cavity 92, which can lead to increased planarity, among other benefits.

While the foregoing embodiments illustrated and discussed herein relate to a micro-fluid ejection head assembly that may be integral with a fluid reservoir body, it will be appreciated that the advantages and benefits described herein are applicable to embodiments where the head assembly is in fluid communication with a separate reservoir of fluid (e.g., as may be the case when an ejection head is supplied with fluid from an "off-carrier" ink supply), and to embodiments where the head assembly is in fluid communication with a removable fluid reservoir (e.g., as may be the case in a device that utilizes a "semipermanent print head" that is supplied with ink from a "tank" and/or "chicklet"). Accordingly, the disclosure is not limited to embodiments wherein a micro-fluid ejection head is attached directly to a fluid reservoir body.

Having described various aspects and embodiments of the disclosure and several advantages thereof, it will be recognized by those of ordinary skills that the embodiments are susceptible to various modifications, substitutions and revisions within the spirit and scope of the appended claims.

What is claimed is:

1. A fluid ejection head assembly comprising:

a substrate cavity, a substantially planar surface surrounding the substrate cavity, the substantially planar surface containing:

at least one external vent, at least one internal vent channel, and a plurality of vents in fluid flow communication with the substrate cavity providing fluid flow communication between the internal vent channel and the external vent, wherein the plurality of vents, the at least one external vent and the at least one internal vent channel are disposed in fluid flow communication with an environment external to the substrate cavity for flow of a gas associated with an adhesive at least partially disposed in at least one of the subs ate cavity and the at least one internal vent channel, to the environment during the curing of the adhesive.

2. The fluid ejection head assembly of claim 1 wherein:

the external vent comprises a vent channel having a depth that is at least as deep as a depth of the internal vent channel.

3. The fluid ejection head assembly of claim 2 wherein:

the external vent channel depth is substantially twice the internal vent channel depth.

4. The fluid ejection head assembly of claim 2 wherein the external vent channel depth ranges from about 0.2 to about 0.3 millimeters and the internal vent channel depth ranges from about 0.08 to about 0.15 millimeters.

5. The fluid ejection head assembly of claim 1 wherein the internal vent channel has at least one slanted side wall.

6. The fluid ejection head assembly of claim 1 wherein the substantially planar surface further comprises a deck disposed adjacent to the external vent for adhesively attaching a flexible circuit thereto.

7. The fluid ejection head assembly of claim 1 wherein the plurality of vents are spaced along a length of the substrate cavity at periodic intervals ranging from about 0.5 to about 1.5 millimeters.

8. The fluid ejection assembly of claim 1, further comprising:

a micro-fluid ejection head adhesively attached in the substrate cavity; and a flexible circuit adhesively attached to the deck and electrically connected to the micro-fluid ejection head for control of fluid ejection from the micro-fluid ejection head.

9. A method for improving sealing between a circuit and a fluid ejection assembly, the fluid ejection assembly having a substantially planar surface, a substrate cavity, and a vent system placing the substrate cavity in fluid flow communication with an environment external to the substrate cavity, wherein the vent system includes an internal vent channel, an external vent, and a plurality of connecting vent channels connecting the internal vent channel and the external vent to one another, the method comprising:

disposing an amount of adhesive in the substrate cavity and in the internal vent channel sufficient to substantially attach and to substantially seal a substrate in the substrate cavity, and to substantially seal a backside of a circuit, thereby enhancing corrosion protection of lead beams on the circuit.

10. The method of claim 9 wherein the internal vent channel has a first depth and the external vent comprises a channel having a second depth wherein the first depth is no greater than the second depth.

11. The method of claim 9 wherein the connecting vent channel has a periodic spacing along a length of the substrate cavity ranging from about 0.5 to about 1.5 millimeters.

12. The method of claim 9 wherein the internal vent channel has at le St one slanted side wall.

13. A method for improving sealing between a circuit and a fluid ejection assembly having a substantially planar surface substantially surrounding a recessed substrate cavity, a vent system in the substantially planar surface, wherein the vent system is in fluid flow communication with the substrate cavity, the vent system comprising:

at least one external vent, at least one internal vent channel disposed between the external vent and the substrate cavity, and a plurality of connecting vent channels orthogonal to the internal vent channels, wherein the connecting vent channels are in fluid flow communication with the substrate cavity, the internal vent channel and the external vent, the method comprising:

dispensing an adhesive in at least one of the substrate cavity and the at least one internal vent channel to substantially fill the substrate cavity and flow into the vent system;

attaching a micro-fluid ejection head to the adhesive in the substrate cavity;

attaching a circuit to the micro-fluid ejection head and at least a portion of the substantially planar surface; and curing the adhesive.

14. The method of claim 13 wherein the internal vent channel has a first depth and the external vent comprises a channel having a second depth, wherein the first depth is no greater than the second depth.

15. The method of claim 14 wherein the first depth is about half of the second depth.

16. The method of claim 13 wherein the connecting vent channels have a periodic spacing along a length of the substrate cavity ranging from about 0.5 to about 1.5 millimeters.

17. The method of claim 13, wherein the internal vent channel has at least one slanted side wall.

18. A micro-fluid ejection head device comprising:

a recessed substrate cavity;

a substantially planer surface substantially surrounding the substrate cavity; and a vent system disposed in the substantially planar surface in fluid flow communication with the substrate cavity and an environment external to the substrate cavity, wherein the vent system comprises an internal vent channel, an external vent, and a plurality of connecting channels orthogonal to the internal vent channel wherein the connecting channels are in fluid flow communication with the substrate cavity, the internal vent channel and the external vent.

19. The micro-fluid ejection head device of claim 18 wherein the substantially planar surface is disposed between he external vent and an edge of the substrate cavity, and wherein a flexible circuit is attached to the substantially planar surface.

20. The micro-fluid ejection head device of claim 18 wherein the external vent comprises an opening between the substantially planar surface and an edge of a portion of the device.

* * * * *

UNITED STATES PATENT AND TRADEMARK OFFICE

CERTIFICATE OF CORRECTION

PATENT NO. : 7,600,850 B2
APPLICATION NO. : 11/365193
DATED : October 13, 2009
INVENTOR(S) : Blackburn et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 633 days.

Signed and Sealed this

Fifth Day of October, 2010

David J. Kappos

David J. Kappos
*Director of the United States Patent and Trademark Office*